US011338417B2

(12) United States Patent
Hsieh

(10) Patent No.: US 11,338,417 B2
(45) Date of Patent: May 24, 2022

(54) TORQUE WRENCH CAPABLE OF MAINTAINING ACCURACY OF TORQUE VALUE

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 0 days.

(21) Appl. No.: 17/142,639

(22) Filed: Jan. 6, 2021

(65) Prior Publication Data

US 2021/0276168 A1 Sep. 9, 2021

(30) Foreign Application Priority Data

Mar. 4, 2020 (TW) ..... 109107116

(51) Int. Cl.
*B25B 23/142* (2006.01)
*B25B 23/14* (2006.01)

(52) U.S. Cl.
CPC ..... *B25B 23/1427* (2013.01); *B25B 23/141* (2013.01)

(58) Field of Classification Search
None
See application file for complete search history.

(56) References Cited

U.S. PATENT DOCUMENTS 5,129,293 A * 7/1992 Larson ..... B25B 23/1427 81/478
9,149,918 B2 * 10/2015 Lee ..... B25B 23/1427
2011/0314976 A1 * 12/2011 Anjanappa ..... B25B 23/1427 81/480
2013/0228053 A1 * 9/2013 Chen ..... B25B 23/1427 81/467
2017/0348836 A1 * 12/2017 Hu ..... B25B 23/0028
2018/0141193 A1 * 5/2018 Chen ..... B25B 23/1427

* cited by examiner

*Primary Examiner* — Brian D Keller
*Assistant Examiner* — Makena S Markman
(74) *Attorney, Agent, or Firm* — Guice Patents PLLC

(57) ABSTRACT

The invention provides a torque wrench capable of maintaining accuracy of torque value, comprising a tube; and a rod, a trip mechanism, an elastic element, and an adjustment mechanism installed on the tube. The adjustment mechanism has a handle and a moving member, when the handle is rotated, the moving member can be driven to displace along a longitudinal direction of the tube, so as to change an elastic force exerted by the elastic element to the trip mechanism; an adjustment rod is threadedly connected into the moving member, rotating the adjustment rod is capable of displacing the adjustment rod relative to the moving member, so that a front end of the adjustment rod protrudes from the moving member and exerts pressure on the elastic element. Thereby, the torque wrench can be restored to a correct torque value by simply rotating the adjustment rod.

11 Claims, 5 Drawing Sheets

TORQUE WRENCH CAPABLE OF MAINTAINING ACCURACY OF TORQUE VALUE

BACKGROUND OF THE INVENTION

Field of Invention

The invention relates to torque wrenches, and more specifically refers to a torque wrench capable of maintaining accuracy of torque value.

Related Art

Torque wrench has the function of setting a torque and has a warning effect. When an applied force of the wrench reaches a set torque value, it will produce a warning effect. A mechanical torque wrench has a trip mechanism, an elastic element is used to abut against the trip mechanism, and an adjustment mechanism is provided at a rear end of the wrench capable of changing an elastic force exerted by the elastic element on the trip mechanism; scales are set on the wrench, through the scales the torque value set for the wrench can be displayed. When in use, when a force applied by the wrench to turn a bolt or a nut exceeds the set torque value, the trip mechanism will trip, and then generate vibration and sound, so that the user knows that the force exerted by the wrench has reached the set value.

After the torque wrench has been used for a long period of time, its components will wear out. For example, the trip mechanism will have obvious wear, and the elastic element may also be elastically fatigued, which causes the torque value set by the wrench being not the actual torque value, that is, the set torque value displayed on the scales is not consistent with the actual torque value. For example, the torque value set by the user for the wrench is 30 Newton meters, however, the actual torque value when the wrench's trip mechanism is tripped is only 28 Newton meters, resulting in bolts or nuts not being tightened to the required torque value, which affects the safety of mechanical equipment or buildings.

SUMMARY OF THE INVENTION

A main object of the invention is to provide a torque wrench with a design capable of conveniently adjusting a torque in order to maintain an accuracy of a torque value of the wrench.

A torque wrench capable of maintaining accuracy of torque value provided by the invention comprising:

a tube;

a rod pivotally disposed at a front end of the tube and capable of swinging, a rear end of the rod being located in the tube; a head provided at a front end of the rod;

a trip mechanism disposed at the rear end of the rod;

an elastic element disposed in the tube, an elastic force of the elastic element acting on the trip mechanism;

an adjustment mechanism having a handle and a moving member, the handle being rotatably sleeved on a rear end of the tube, the moving member being disposed in the tube and capable of displacing along a longitudinal direction of the tube, a front end of the moving member exerting pressure on a rear end of the elastic element; rotating the handle being capable of driving the moving member to displace along the longitudinal direction of the tube; further comprising:

a thread-connection hole disposed in the moving member along a longitudinal direction of the moving member; and an adjustment rod threadedly connected into the thread-connection hole of the moving member, rotating the adjustment rod being capable of displacing the adjustment rod relative to the moving member, so that a front end of the adjustment rod protruding from the moving member and exerting pressure on the elastic element.

Thereby, when the torque wrench has an error in a torque value due to component wear, the user needs simply to rotate the adjustment rod, so as to change an elastic force of the elastic element by the adjustment rod, to compensate the error caused by wear and to make the wrench restore to a correct torque value.

BRIEF DESCRIPTION OF THE DRAWINGS

In order to enable the examiner to further understand the objects, features, and achieved efficacies of the invention, three preferred embodiments are listed below for detailed explanation in conjunction with the drawings, wherein.

DETAILED DESCRIPTION OF THE INVENTION

Figure 1:
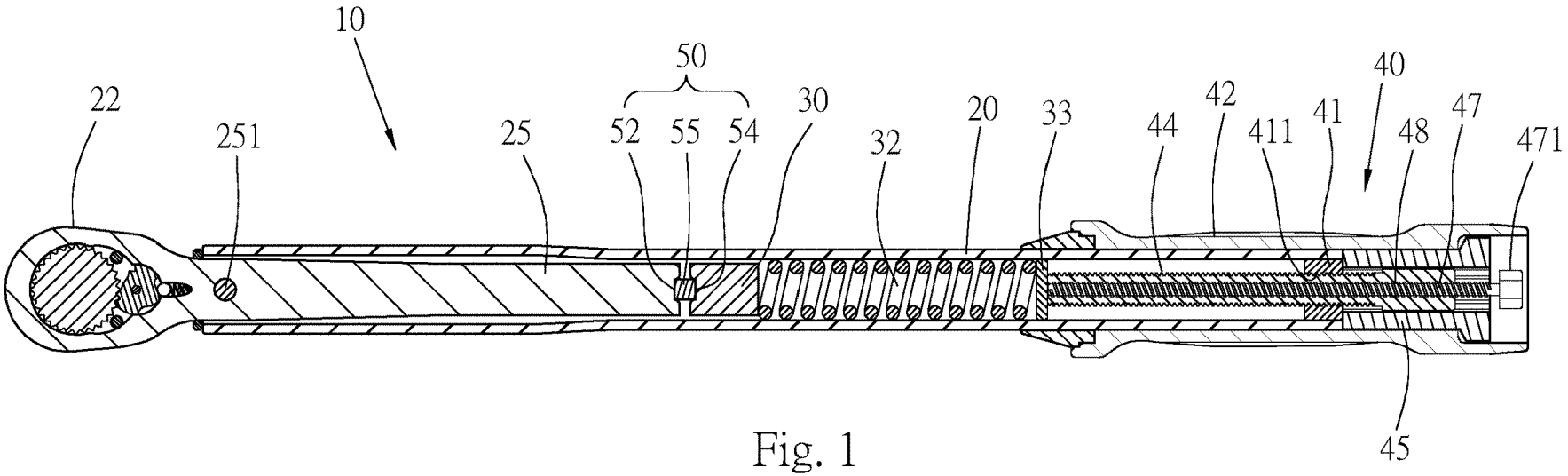
FIG. 1 is a front longitudinal sectional view of a torque wrench of a first preferred embodiment of the invention.
Figure 2:
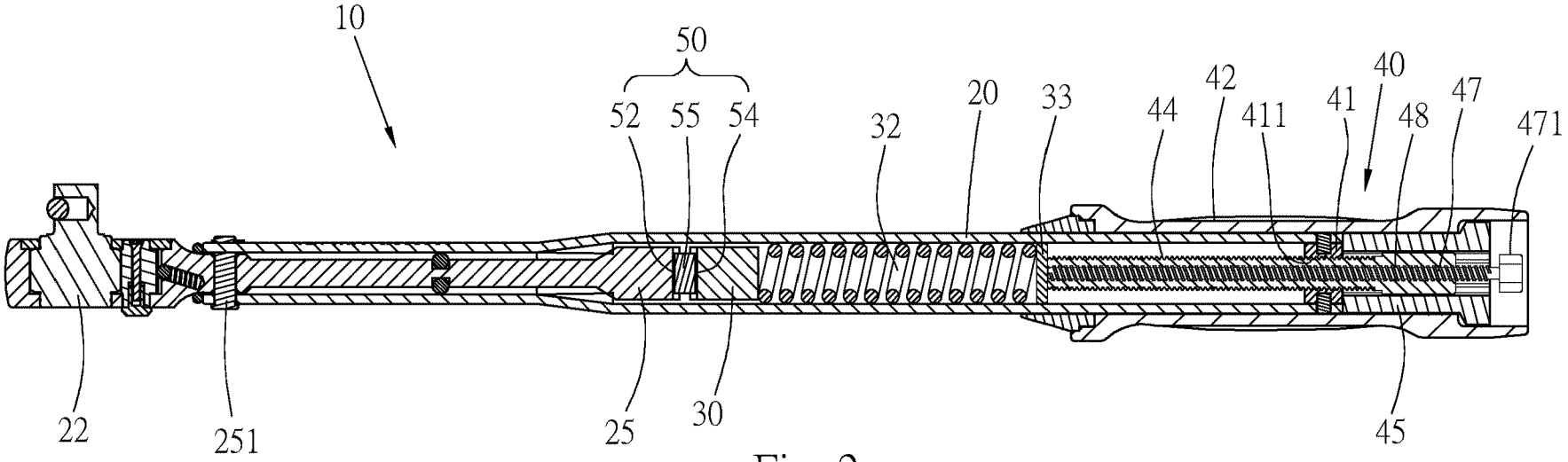
FIG. 2 is a side longitudinal sectional view of the torque wrench of the first preferred embodiment of the invention.

Please refer to FIGS. 1 to 2 for a preferred embodiment of a torque wrench 10 provided by the invention. The wrench 10 is a torque wrench with a mechanical structure. A design object of the invention is to use a unique adjustment rod 47 of the wrench 10 to maintain an accuracy of a torque of the mechanical structure.

Figure 3:
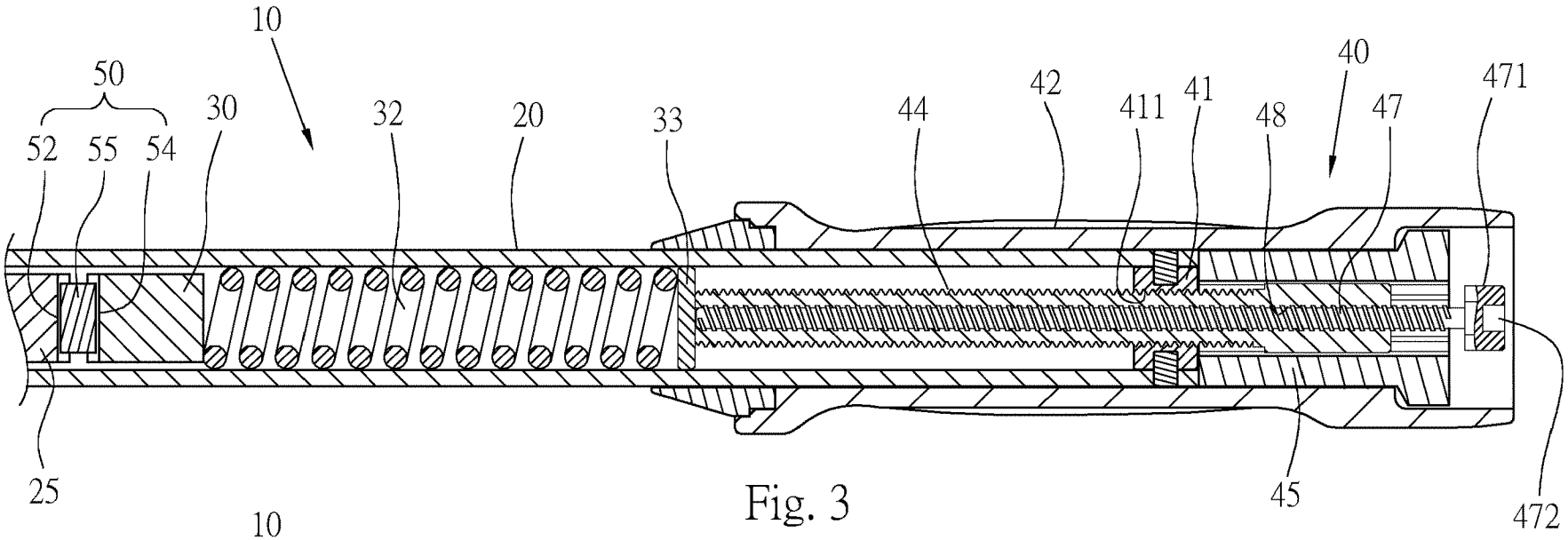
FIG. 3 is a partial enlarged view of FIG. 1.

The structure of the torque wrench 10 of a first preferred embodiment of the invention will be described hereinafter. Please refer to FIG. 3, the wrench 10 has:

a tube 20, a rod 25, and a head 22 disposed at a front end of the rod 25, the head 22 can be in a structural form of an open-end wrench, a socket wrench or a ratchet wrench, but is not limited to the structure of this embodiment; the wrench 10 uses the head 22 to rotate a screw connection member (bolt or nut) or a socket, the rod 25 is pivotally disposed at a front end of the tube 20 with a pivot 251 to be capable of swinging with the pivot 251 as a pivot point of rotation, a rear end of the rod 25 is located inside the tube 20, and the head 22 is located outside the tube 20;

an abutting member 30, an elastic element (which is a compression spring) 32 and a washer 33 sequentially disposed in the tube 20 from front to back, the abutting member 30 is located behind the rod 25 and is capable of sliding in the tube 20, the elastic element 32 is located between the abutting member 30 and the washer 33, front and rear ends of the elastic element 32 elastically abut against the abutting member 30 and the washer 33 respectively, the washer 33 is also capable of sliding in the tube 20, and is disposed between the elastic element 32 and an adjustment mechanism 40 to transmit a force exerted by the adjustment mechanism 40 to the elastic element 32;

the adjustment mechanism 40 including a handle 42 and a moving member, the moving member is disposed in the tube 20 to be capable of displacing along a longitudinal direction of the tube 20, a front end of the movable member contacts/abuts against the washer 33, when the handle 42 is rotated, the moving member can be driven to displace in the tube 20, in this embodiment, the moving member is a screw 44; a fixing member 41 is fixedly disposed in the tube 20 and has a screw hole 411; the screw 44 is screwed in the screw hole 411 of the fixing member 41, thereby, the screw 44 is capable of displacing in the tube 20 when being rotated, a front end of the screw 44 is capable of directly contacting the elastic element 32; in this embodiment, the front end of the screw 44 contacts the elastic element 32 via the washer 33, the handle 42 is rotatably sleeved on an outer peripheral surface of a rear end of the tube 20; a rear end of the screw 44 is directly connected to the handle 42 or indirectly connected to the handle 42 through other components, in this embodiment, a rear end of the handle 42 is connected to the rear end of the screw 44 via a connecting member 45, when the handle 42 is rotated, the screw 44 is driven to rotate together, thereby driving the screw 44 and the washer 33 to displace to different positions along the longitudinal direction of the tube 20 to be capable of changing an elastic force exerted by the elastic element 32 on the abutting member 30; and a trip mechanism 50 disposed between the rear end of the rod 25 and the abutting member 30, when a force applied by the wrench 10 exceeds a set torque value, the trip mechanism 50 generates a trip effect, the trip mechanism 50 can be of different forms, this embodiment discloses one form of trip mechanism, but it is not limited thereto, the trip mechanism 50 includes a first recess 52 provided at the rear end of the rod 25, a second recess 54 provided at a front end of the abutting member 30, and an abutting block 55 in rectangular or cubic shape, the abutting block 55 is in contact with the two recesses 52, 54, since the abutting member 30 bears an elastic force of the elastic element 32, the abutting block 55 is elastically clamped by the abutting member 30 and the rod 25, when the trip mechanism 50 is in a normal state, the two recesses 52, 54 are directly opposite to each other, and front and rear end surfaces of the abutting block 55 are in contact with the two recesses 52, 54 respectively.

The torque wrench 10 of the invention is further provided with a thread-connection hole 48 and the adjustment rod 47. The thread-connection hole 48 is disposed in the screw 44 along a longitudinal direction of the screw 44 and penetrates the screw 44; an outer peripheral surface of the adjustment rod 47 has a screw thread, a length of the adjustment rod 47 is longer than that of the screw 44, and the adjustment rod 47 is screwed into the thread-connection hole 48 of the screw 44, it should be explained that it is not necessary that an entire hole wall of the thread-connection hole 48 and an entire peripheral surface of the adjustment rod 47 have screw threads. A rear end of the adjustment rod 47 is exposed outside the rear end of the screw 44, an operating section is provided at the rear end of the adjustment rod 47, and the adjustment rod 47 can be rotated with the operating section. The operating section has two forms in this embodiment, one of which is a non-circular peripheral surface, for example, an outer peripheral section 471 with a polygonal (for example, hexagonal) peripheral surface for tools to sleeve on the outer peripheral section 471 and rotate the adjustment rod 47; the operating section can also be a non-circular recessed hole 472, such as the polygonal (hexagonal) recessed hole 472 for turning the adjustment rod 47 with a tool (hexagonal wrench). When the adjustment rod 47 is rotated, the adjustment rod 47 is capable of rotating in the thread-connection hole 48 of the screw 44, and a relative displacement is generated between the adjustment rod 47 and the screw 44, so that the adjustment rod 47 independently abuts against the elastic element 32 to adjust an elastic force of the elastic element 32.

When the torque wrench 10 of the invention is used, a user can set a torque value of the wrench 10 through the adjustment mechanism 40, and rotating the handle 42 is capable of driving the screw 44 to displace along the longitudinal direction of the tube 20, thereby changing a resilience of the elastic element 32. When the elastic element 32 abuts against the abutting member 30 with a relatively large elastic force, the wrench 10 is set to a relatively high torque value, so that the trip mechanism 50 needs to bear a relatively large acting force to be tripped; on the contrary, when the elastic element 32 abuts against the abutting member 30 with a relatively small elastic force, the wrench 10 is set to a relatively low torque value. When the handle 42 is rotated to adjust a torque value of the wrench 10, the adjustment rod 47 is displaced together with the screw 44.

When a force of the wrench 10 to rotate a screw connection member or a socket reaches a set torque, the trip mechanism 50 will slip/trip, and the rear end of the rod 25 and the abutting member 30 will swing offsetly toward two sides respectively, and the two recesses 52, 54 are in a misaligned state and are not directly opposite to each other. When the trip mechanism 50 trips, the trip mechanism 50 will vibrate and make a sound, with the vibration and sound, the user can easily and quickly determine that an applied force of the wrench 10 has reached a set torque value.

When the wrench 10 is used for a period of time, the components of the wrench 10 will wear out. For example, the trip mechanism 50 will wear out, or an elasticity of the elastic element 32 will be weakened. The wear of any component will reduce an elastic force of the elastic element 32 exerting on the abutting member 30, which causes errors in a torque value of the wrench 10. When there is an error in a torque value of the wrench 10, the structure of the invention is capable of easily restoring the torque value of the wrench 10 to a correct torque value. Please refer to FIG. 4, a torque test instrument can be used to read an actual torque value of the wrench 10, and the adjustment rod 47 can be rotated with the operating section so that the adjustment rod 47 is displaced in the screw 44 along the longitudinal direction of the tube 20. At this time, the handle 42 is not rotated, the screw 44 is not rotated and remains stationary, and is not displaced, a front end of the adjustment rod 47 protrudes from the screw 44, and the elastic element 32 is compressed through the washer 33 to restore to a correct torque value of the wrench 10. Thus, a torque value error caused by the wear of the components of the wrench 10 can be compensated, so that reading (for example, torque value displayed on the scales of the tube 20) of an actual torque value of the wrench 10 is consistent with reading of a torque value of the wrench 10.

Figure 4:
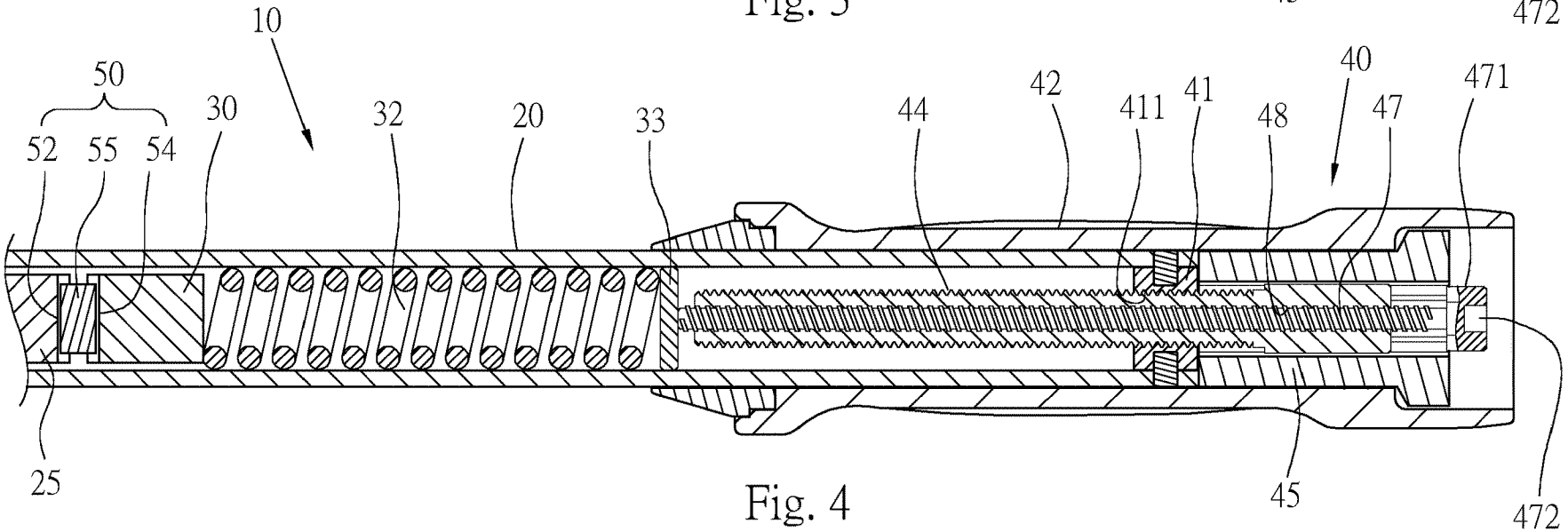
FIG. 4 is an actuation diagram of the torque wrench of the first preferred embodiment of the invention showing a state of adjusting a torque.

Afterwards, if the user wants to set the torque wrench 10 to different torque values, he or she can simply turn the handle 42 to drive the screw 44 to displace, and the screw 44 and the adjustment rod 47 displace together while being maintained in a state shown in FIG. 4 and compress or release the elastic element 32. After being used for a period of time, if the torque wrench 10 has an error in torque value again, the wrench 10 can be restored to a correct torque value by turning the adjustment rod 47 again.

When the wrench is to be calibrated and restored to a correct torque value, only the adjustment rod 47 needs to be adjusted, and the wrench 10 does not need to be disassembled and assembled, thereby the required costs and time is saved substantially.

Figure 5:
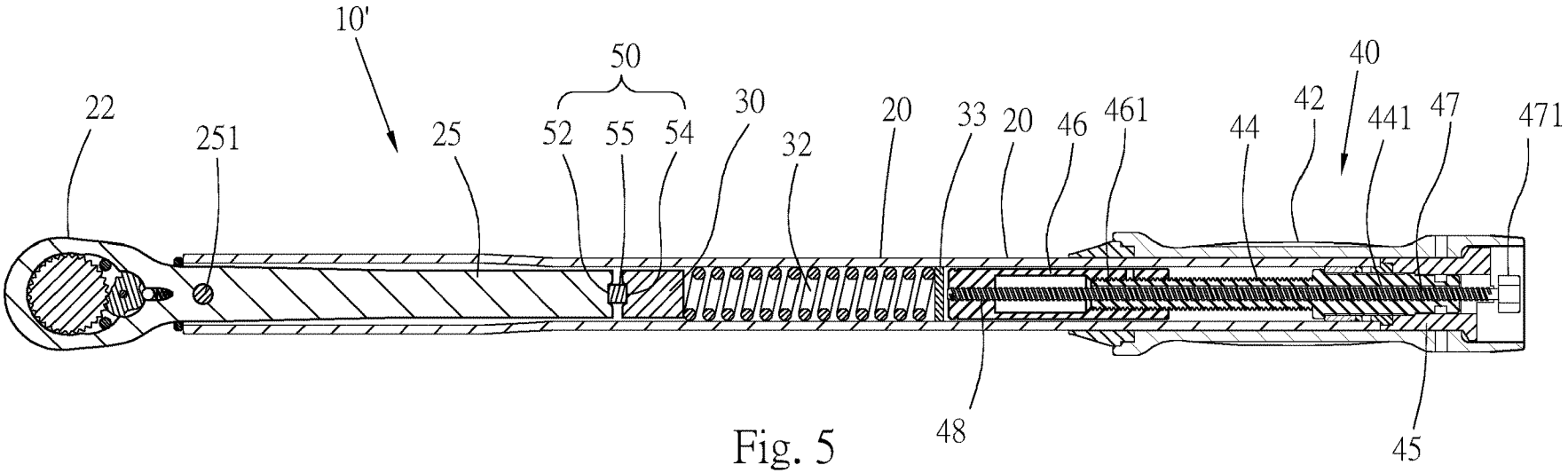
FIG. 5 is a front longitudinal sectional view of the torque wrench of a second preferred embodiment of the invention.
Figure 6:
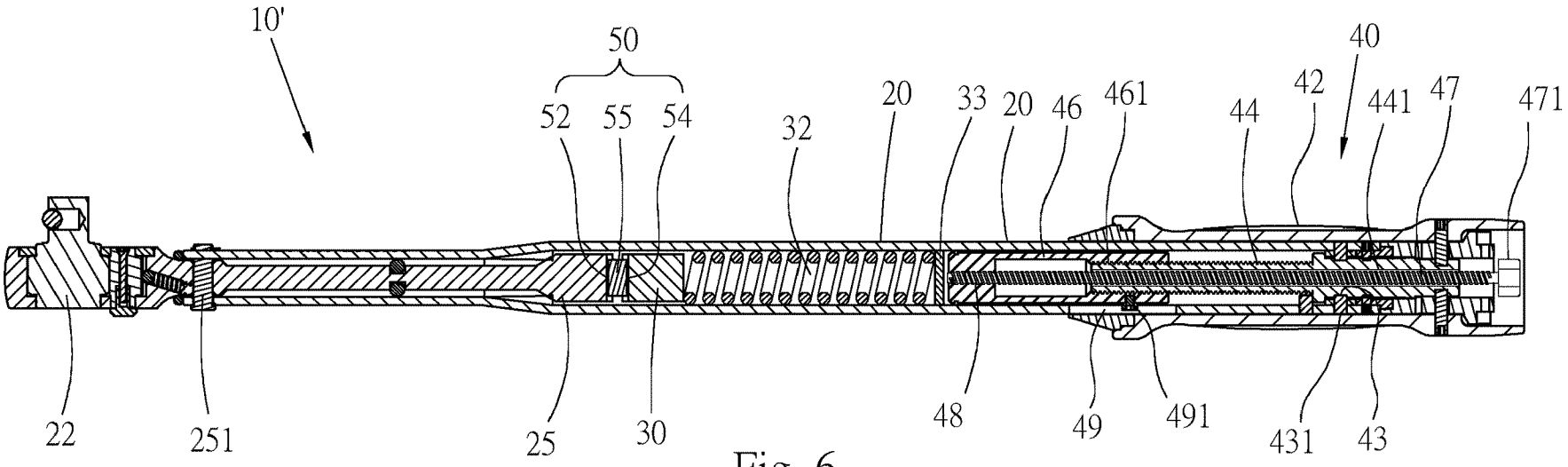
FIG. 6 is a side longitudinal sectional view of the torque wrench of the second preferred embodiment of the invention.
Figure 7:
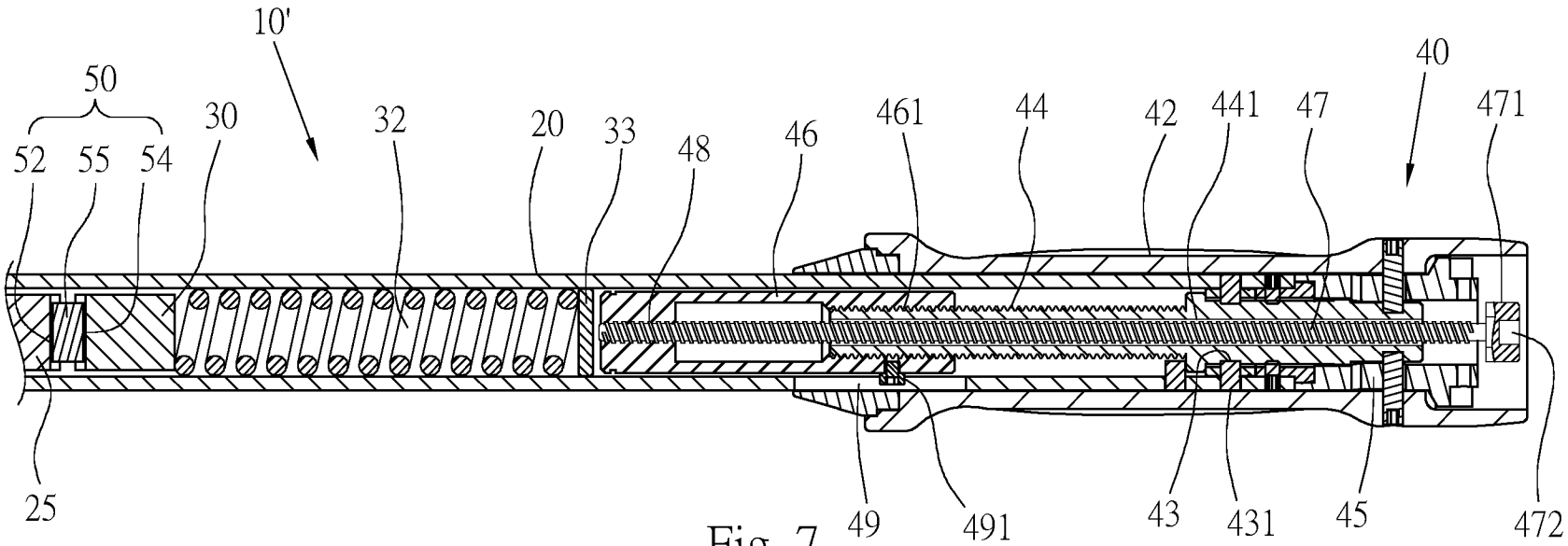
FIG. 7 is a partial enlarged view of FIG. 5.

FIGS. 5 to 7 are a second preferred embodiment of a wrench 10' of the invention, which also comprises the tube 20, the rod 25, the head 22, the abutting member 30, the elastic element 32, the washer 33, the adjustment mechanism 40, the moving member, the adjustment rod 47 and the trip mechanism 50, the same components are indicated by the same component numerals, and the structural features of the components can be referred to the description of the first preferred embodiment, thus will not be repeated herein.

In this embodiment, the moving member includes the screw 44 and a tubular sliding member 46, and the front end of the screw 44 is threadedly connected into a screw hole 461 at a rear end of the sliding member 46, a through hole 441 is provided inside the screw 44, and the through hole 441 penetrates the screw 44 along the longitudinal direction of the screw 44; and the thread-connection hole 48 is provided in the sliding member 46 along a longitudinal direction of the sliding member 46. A tube wall of the tube 20 is disposed with a longitudinal groove 49 along the longitudinal direction, a position of the groove 49 corresponds to the sliding member 46, a limiting element 491 (for example, a small screw or pin) is fixed to a peripheral surface of the sliding member 46, and one end of the limiting element 491 is embedded in the groove 49, so that the sliding member 46 is capable of sliding in the tube 20, but incapable of rotating. An outer peripheral surface of the rear end of the screw 44 is recessed with a ring groove 43, at least one limiting pin 431 is fixedly connected to the tube 20, and one end of the limiting pin 431 is embedded in the ring groove 43, so that the screw 44 is capable of only rotating in the tube 20 but incapable of displacing. The handle 42 is fixedly connected to the rear end of the screw 44 by a connecting member 45, when the handle 42 is rotated, the screw 44 rotates with the handle 42 and the screw 44 drives the sliding member 46 to slide back and forth along the longitudinal direction of the tube 20, which causes a front end of the sliding member 46 to compress or release the elastic element 32 to change an elastic force of the elastic element 32 exerting on the abutting member 30.

A length of the adjustment rod 47 is longer than that of the moving member, the adjustment rod 47 is inserted into the through hole 441 of the screw 44 and is threadedly connected into the thread-connection hole 48 of the sliding member 46. Rotating the adjustment rod 47 with the outer peripheral section 471 or the recessed hole 472 is capable of displacing the adjustment rod 47 relative to the sliding member 46, thereby abutting against the elastic element 32 and adjusting an elastic force of the elastic element 32. It is not necessary for entire lengths of the screw 44 and the adjustment rod 47 to have screw threads, for example, screw threads can be provided at the front end of the screw 44 and the front end of the adjustment rod 47.

When a torque value of the torque wrench 10' has an error, the structure of this embodiment is capable of simply restoring the wrench 10' to a correct torque value. Please refer to FIG. 8, the adjustment rod 47 is rotated with the operating section (the outer peripheral section 471 or the recessed hole 472), so that the adjustment rod 47 is displaced in the screw 44 and the sliding member 46 along the longitudinal direction of the tube 20, at this time, since the handle 42 is not rotated, the screw 44 and the sliding member 46 remain stationary and are not moved. The front end of the adjustment rod 47 protrudes from the sliding member 46, thereby compressing the elastic element 32 and restoring the wrench 10' to a correct torque value, so that reading of an actual torque value of the wrench 10' is consistent with reading of a torque value of the wrench 10'.

Figure 8:
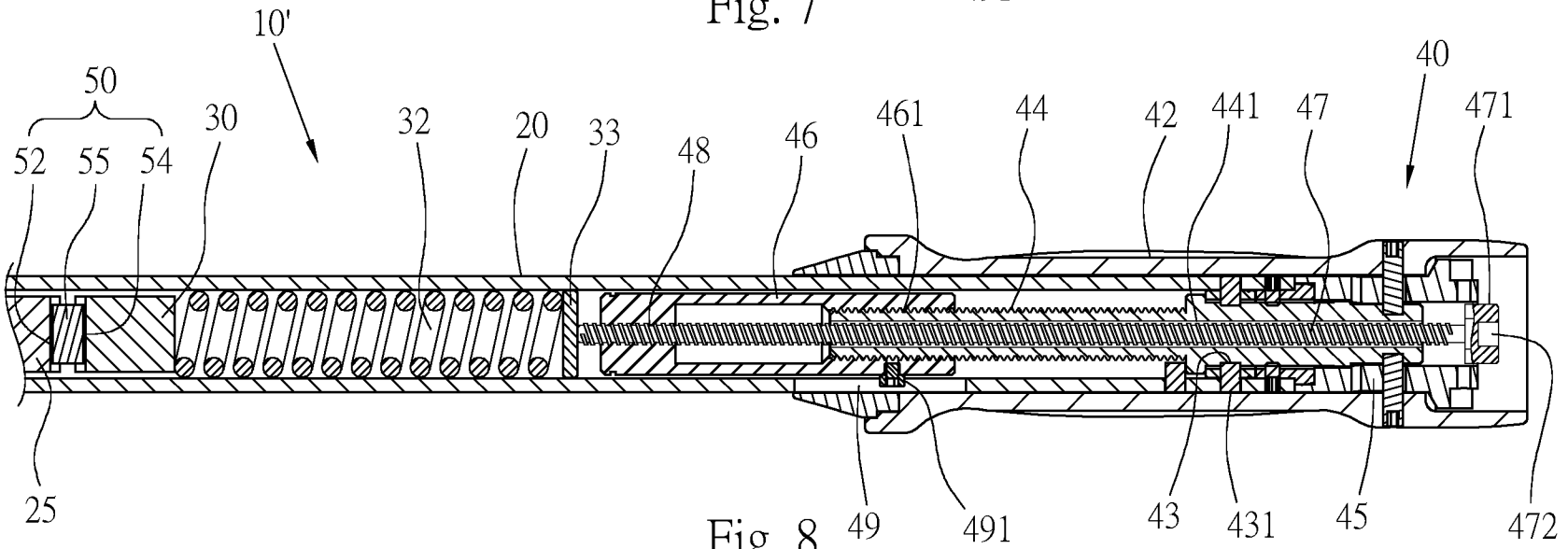
FIG. 8 is an actuation diagram of the torque wrench of the second preferred embodiment of the invention showing a state of adjusting a torque.

Similarly, if the user wants to set the torque wrench 10' to different torque values, simply turns the handle 42 to drive the moving member to displace, and the adjustment rod 47 and the sliding member 46 displace together while being maintained in a state shown in FIG. 8 and compress or release the elastic element 32. If an error occurs in a torque value again, the wrench 10' can be restored to a correct torque value by turning the adjustment rod 47 again.

Figure 9:
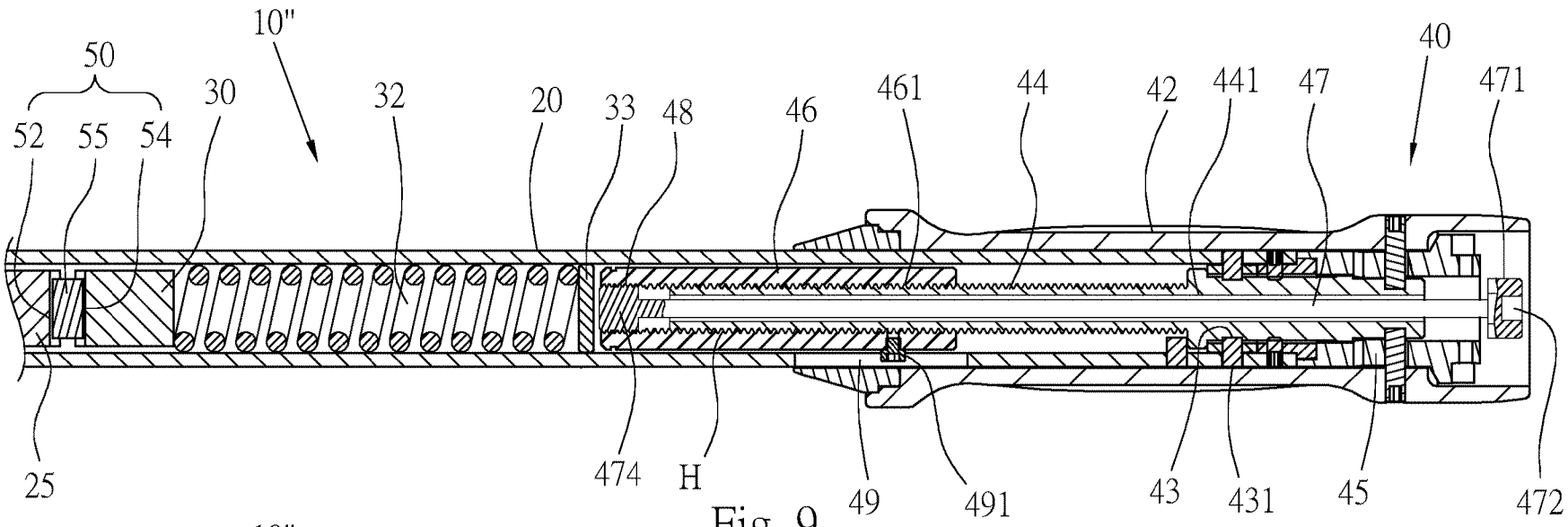
FIG. 9 is a partial longitudinal sectional view of the torque wrench of a third preferred embodiment of the invention.

FIG. 9 shows a third preferred embodiment of the wrench 10" of the invention, which also comprises: the tube 20, the rod 25, the head, the abutting member 30, the elastic element 32, the washer 33, the adjustment mechanism 40, the moving member, the adjustment rod 47 and the trip mechanism 50. The same components are indicated by the same component numerals, and the same components can be referred to the description of the second preferred embodiment, thus will not be repeated herein.

The moving member of this embodiment also includes the screw 44 and the tubular sliding member 46, the screw 44 is capable of only rotating in situ and is incapable of displacing, the front end of the screw 44 is threadedly connected into the sliding member 46, and the sliding member 46 is limited by the limiting element 491 and the longitudinal groove 49 to be capable of only displacing along the tube 20 but incapable of rotating. When the screw 44 is rotated by the handle 42, the screw 44 drives the sliding member 46 to displace along the longitudinal direction of the tube 20, thereby changing a resilience of the elastic element 32 to adjust a torque value of the wrench 10".

The adjustment rod 47 is inserted into the through hole 441 of the screw 44, and the front end of the adjustment rod 47 protrudes from the front end of the screw 44 and is threadedly connected into the thread-connection hole 48 provided on an inner peripheral surface of the sliding member 46. When the screw 44 drives the sliding member 46 to displace, the adjustment rod 47 displaces together with the sliding member 46.

In this preferred embodiment, the front end of the adjustment rod 47 has a large-diameter portion 474 that exposes at the front end of the screw 44 and is threadedly connected into the thread-connection hole 48 of the sliding member 46. The front end of the screw 44 is threadedly connected into the screw hole 461 of the sliding member 46. The thread-connection hole 48 and the screw hole 461 are both formed on the inner peripheral surface of the sliding member 46, and can be formed in a same hole H of the sliding member 46. In other words, the thread-connection hole 48 and the screw hole 461 can be the same hole H, a screw thread of the thread-connection hole 48 and a screw thread of the screw hole 461 are disposed front and back on the sliding member 46, the screw thread of the thread-connection hole 48 is at the front and the screw thread of the screw hole 461 is at the back.

The screw threads of the thread-connection hole 48 and the screw hole 461 can have a same pitch or different pitches.

Figure 10:
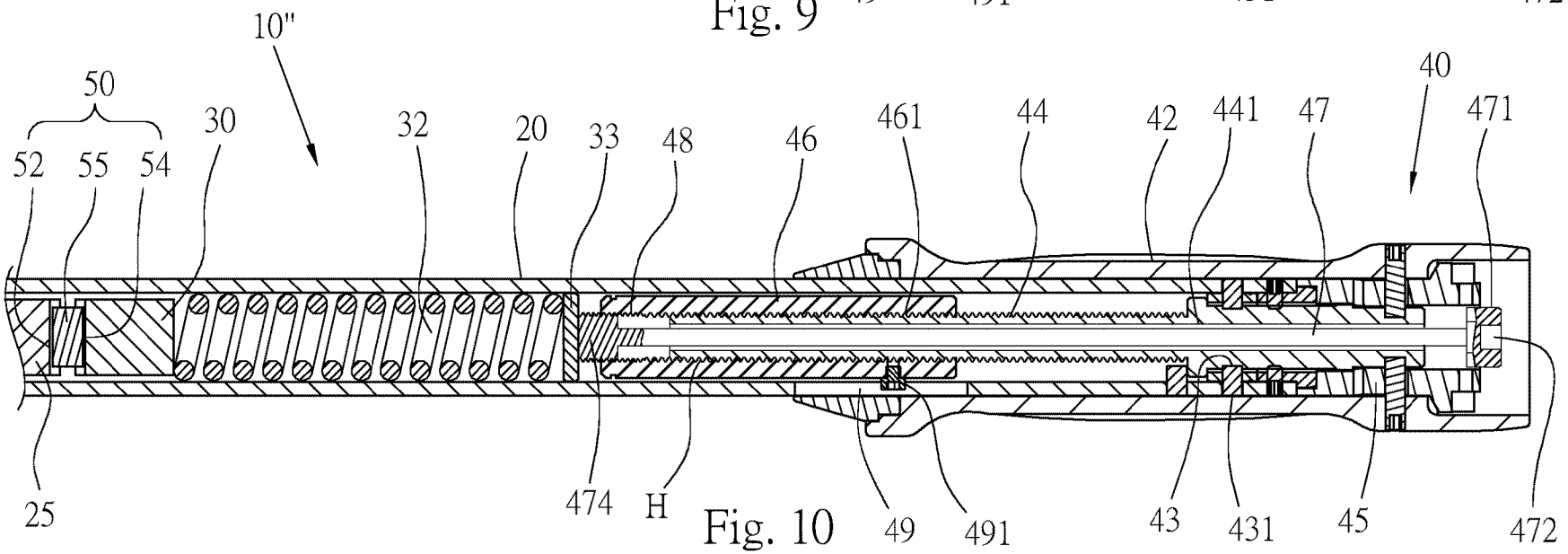
FIG. 10 is an actuation diagram of FIG. 9 showing a state of adjusting a torque of the torque wrench.

When there is an error in a torque value of the torque wrench 10" of this preferred embodiment, please refer to FIG. 10, rotating the adjustment rod 47 with the operating section (the outer peripheral section 471 or the recessed hole 472) is capable of making the front end of the adjustment rod 47 protruding from the front end of the sliding member 46 (the screw 44 and the sliding member 46 remain stationary and are not moved), thereby compressing the elastic element 32 and restoring the wrench 10" to a correct torque value.

A pitch of the screw thread of the thread-connection hole 48 of this preferred embodiment and the second preferred embodiment is smaller than a pitch of the screw thread of the screw hole 461. Therefore, the adjustment rod 47 has a fine adjustment effect when adjusting a torque value of the torque wrench.

With the structure of the invention, the torque wrench can be restored to a correct torque value by rotating the adjustment rod without disassembling and assembling the wrench, so that calibration and adjustment of a torque value of the wrench are more convenient and faster.

It is to be understood that the above description is only preferred embodiments of the present invention and is not used to limit the present invention, and changes in accordance with the concepts of the present invention may be made without departing from the spirit of the present invention, for example, the equivalent effects produced by various transformations, variations, modifications and applications made to the configurations or arrangements shall still fall within the scope covered by the appended claims of the present invention.

What is claimed is:

1. A torque wrench capable of maintaining accuracy of torque value comprising:

a tube;

a rod pivotally disposed at a front end of the tube and capable of swinging, a rear end of the rod being located in the tube; a head provided at a front end of the rod;

a trip mechanism disposed at the rear end of the rod;

an elastic element disposed in the tube and located behind the trip mechanism, an elastic force of the elastic element acting on the trip mechanism;

an adjustment mechanism having a handle and a moving member, the handle being rotatably sleeved on a rear end of the tube, the moving member being disposed in the tube and capable of displacing along a longitudinal direction of the tube, a front end of the moving member exerting pressure on a rear end of the elastic element; rotating the handle being capable of driving the moving member to displace along the longitudinal direction of the tube; further comprising:

a thread-connection hole disposed in the moving member along a longitudinal direction of the moving member; and an adjustment rod threadedly connected into the thread-connection hole of the moving member, rotating the adjustment rod being capable of displacing the adjustment rod relative to the moving member, so that a front end of the adjustment rod protruding from the moving member and exerting pressure on the elastic element;

wherein the moving member includes a screw and a tubular sliding member, the screw is provided with a through hole penetrating the screw longitudinally; a front end of the screw and a rear end of the sliding member are threadedly connected with each other, when the handle is rotated, the screw is driven to rotate, when the screw is rotated, the sliding member is driven to displace along the longitudinal direction of the tube, a front end of the sliding member exerts pressure on the elastic element; the thread-connection hole is disposed in the sliding member; the adjustment rod is inserted into the through hole of the screw and is threadedly connected into the thread-connection hole of the sliding member; the adjustment rod is rotated and the front end of the adjustment rod protrudes from the sliding member.

2. The torque wrench as claimed in claim 1, wherein an operating section is disposed at a rear end of the adjustment rod for rotating the adjustment rod.

3. The torque wrench as claimed in claim 2, wherein the rear end of the adjustment rod has a non-circular outer peripheral surface to form the operating section.

4. The torque wrench as claimed in claim 2, wherein the rear end of the adjustment rod is disposed with a non-circular recessed hole to form the operating section.

5. The torque wrench as claimed in claim 1, wherein the rear end of the adjustment rod is exposed outside the rear end of the moving member.

6. The torque wrench as claimed in claim 1, wherein a length of the adjustment rod is greater than that of the moving member.

7. The torque wrench as claimed in claim 1, further comprising a washer disposed between the elastic element and the adjustment mechanism.

8. The torque wrench as claimed in claim 1, wherein a screw hole is provided in the sliding member and located behind the thread-connection hole; the screw is threadedly connected into the screw hole of the sliding member; and the front end of the adjustment rod is threadedly connected into the thread-connection hole.

9. The torque wrench as claimed in claim 8, wherein a large-diameter portion is formed at the front end of the adjustment rod; and the adjustment rod is threadedly connected into the thread-connection hole with the large-diameter portion.

10. The torque wrench as claimed in claim 8, wherein the thread-connection hole and the screw hole are formed in the sliding member, and a pitch of the thread-connection hole is the same as a pitch of the screw hole.

11. The torque wrench as claimed in claim 8, wherein the thread-connection hole and the screw hole are formed in the sliding member, and a pitch of the thread-connection hole is different from a pitch of the screw hole.

* * * * *